United States Patent [19]

Dimmock

[11] 4,222,607

[45] Sep. 16, 1980

[54] SEATING

[75] Inventor: James Dimmock, Stourbridge, England

[73] Assignee: The Dimmock Furniture Company Limited, Stourbridge, England

[21] Appl. No.: 936,180

[22] Filed: Aug. 23, 1978

[30] Foreign Application Priority Data

Apr. 10, 1977 [GB] United Kingdom ..... 41142/77

[51] Int. Cl.[2] ..... A47C 3/00; A47J 47/16; A47C 1/02

[52] U.S. Cl. ..... 297/284; 248/394; 297/317; 297/320; 297/341

[58] Field of Search ..... 248/394–396; 297/284, 312–318, 320–322, 340–343

[56] References Cited

U.S. PATENT DOCUMENTS

| | | | |
|---|---|---|---|
| 717,026 | 12/1902 | Ostendorf | 297/320 |
| 945,149 | 1/1910 | Anthony | 297/342 |
| 1,228,771 | 6/1917 | Hanger | 297/317 X |
| 1,789,337 | 1/1931 | Knabusch et al. | 297/342 |
| 1,789,821 | 1/1931 | Leffingwell | 297/284 |
| 1,888,471 | 11/1932 | Robbins | 297/321 |
| 2,091,899 | 8/1937 | Whedon et al. | 248/394 |
| 2,712,346 | 7/1955 | Sprinkle | 297/317 X |
| 3,132,897 | 5/1964 | Linden | 297/340 X |
| 3,463,544 | 8/1969 | Froelich | 297/284 |

*Primary Examiner*—James C. Mitchell
*Attorney, Agent, or Firm*—Owen, Wickersham & Erickson

[57] ABSTRACT

This invention is a seating, the seat part of which is adjustable at the front and rear, so as to automatically adjust the angle between the seat part and the back part.

The back part also has a lumber support portion adjustable to compensate for the different angles between the seat and the back parts.

Thus the seating is comfortable for occupants and also provides support for the back.

10 Claims, 5 Drawing Figures

SEATING

FIELD OF THE INVENTION

This invention relates to adjustable seating, particularly, but not exclusively, for use by geriatric patients and persons with back complaints.

DESCRIPTION OF THE PRIOR ART

In the lower spine there is a concavity called the lumbar curve. When a person is standing, powerful muscles maintain this curve, but these muscles should be able to relax when the person is seated.

Most known seats do not provide adequate lumbar support and thus the muscles in the back have to maintain the curve in the spine when a person is seated. As a result, the muscles become tired and an occupant of a seat has to adjust his body position frequently to relieve the tension in the muscles. For geriatric or disabled patients or patients with back complaints for example, it is not convenient to frequently adjust position, and thus the patient may suffer from backache when seated.

Further, inadequate support under the thighs of a patient may aggrevate the condition. Chairs having lumbar supports which may be adjusted to suit users are known such as described in U.K. Pat. No. 1,402,813, and also chairs having adjustable lumbar supports and thigh supports which may be adjusted at the front of the seat only, are known such as described in U.K. Pat. No. 1,199,756, but such chairs do not have angular adjustment between the back part and the seat part. Chairs having adjustable seats are also known, such as described in U.K. Pat. No. 1,375,921 but such chairs do not have lumbar supports.

SUMMARY OF THE INVENTION

An object of the invention is to provide a seating which is comfortable for a user and which may be adjusted so that a user does not need to oontinually adjust his position.

An object of the invention is to provide a new and improved seating comprising a ground engaging frame portion, a seat part and a back part, means for mounting said seat and back parts on the frame portion, an adjustable lumbar support portion, mounting means for mounting said support portion for movement relative to the back part and means to permit raising and lowering movement of both front and rear of the seat part and variation of the angle between the seat part and the back part.

A user of a seating according to the present invention does not need to frequently adjust his position in the seating since raising or lowering of the seat part automatically adjusts the angle between the seat part and the back part so that an adjustment in the seating results in a complete change in the position of the user of the seat and at the same time, the position of the lumbar support portion can be adjusted to suit the individual user of the seat. The lumbar support portion may be adjusted upwardly and downwardly relative to the remainder of the back part. The lumbar support portion may comprise a pad having spaced apart upper and lower edges and said mounting means supporting said pad so that said pad can be pivoted about a horizontal axis intermediate said edges.

A manually engageable member may be connected to the lumbar support portion so that the position of the lumbar support portion may be adjusted by a person sitting in the seating.

The back part may be connected to the seat part so as to move upwardly and downwardly therewith.

The means connecting the seat part and the frame portion may comprise a pivoted link by which the seat part may be connected adjacent its rear end to the frame portion whilst the forward end may be located in any desired one of a plurality of locations which lie on a line which extends upwardly and forwardly, the link being inclined upwardly and rearwardly from the frame part thereby raising and corresponding forward movement of the front of the seat part causes raising and forward movement of the rear end of the seat part.

The seating may be provided with a manually engageable member connected to the seat part, whereby the seat may be adjusted by a person sitting in the seating.

The seating may be provided with upholstered arms, wings and back part, the arms extending within the wings towards the back part and the lumbar support portion being located within the back part.

DESCRIPTION OF PREFERRED EMBODIMENTS

Figure 1:
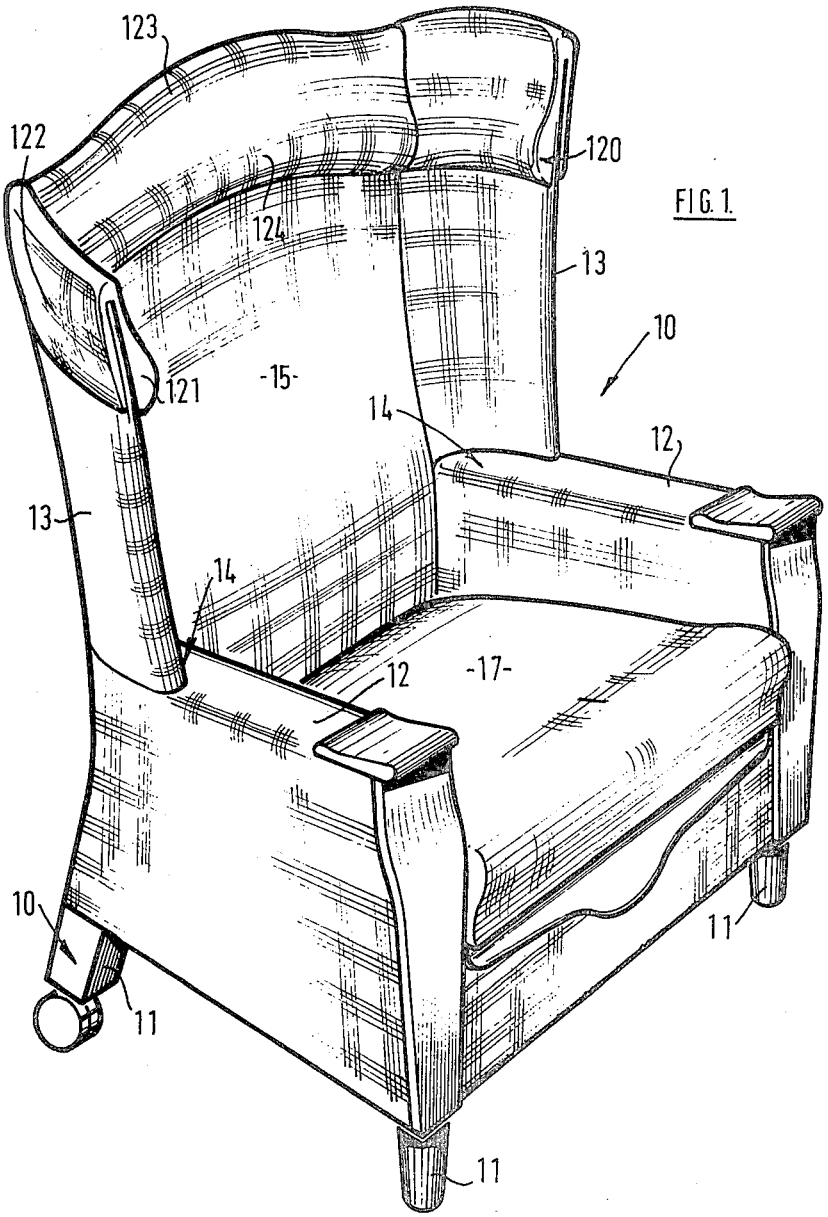
FIG. 1 shows a perspective view of a chair embodying the invention.
Figure 2:
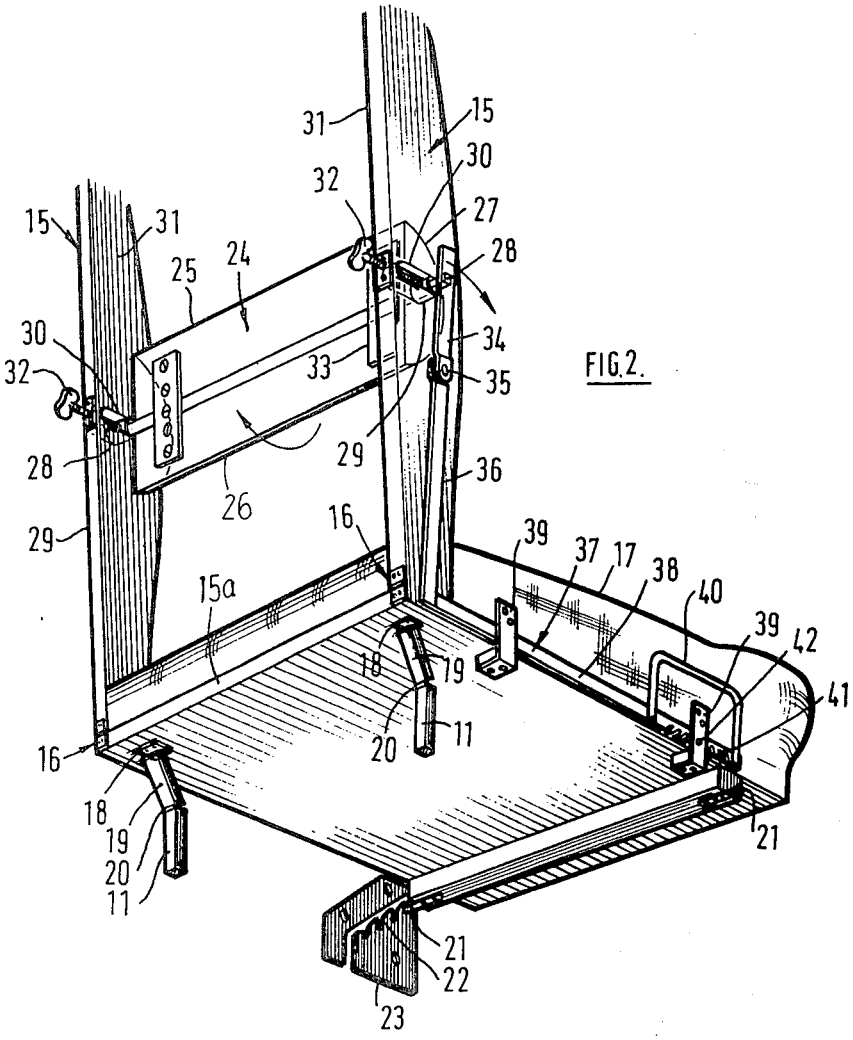
FIG. 2 is a fragmentary perspective view of part of the chair of FIG. 1.

In a first example, referring to FIGS. 1 and 2, a seating, in the form of a chair comprises a wooden frame 10 including four ground engaging legs 11 and a pair of spaced apart upholstered arm portions 12 and a pair of spaced apart wing portions 13. The wing portions 13 are of generally arcuate internal and external configuration and the upper surfaces of the arm portions extend within the wing portions as shown at 14 so that a user of the chair may place his elbows on the upper surface of the arm portion at a position within the wing portions.

Adjacent their upper ends the wing portions 13 may carry a track, not shown, in which is engaged a slider at each side of a back part 15 which is connected by a suitable hinge 16 to the rear of a seat part 15*a*.

The seat part 15*a* has a seat board 17 and adjacent its rear end the seat board 17 is pivotally connected as shown at 18 to a pair of downwardly and forwardly extending links 19 which are pivotally connected as shown at 20 to the legs 11.

At its forward end the seat board 17 is provided with a pair of outwardly extending pins 21 which can be engaged in any one of a numberof cut-outs 22 formed in a track which extends generally upwardly and forwardly in a plate 23 and which is mounted one at each side of the frame 10 at the lower forward ends of the arms 12 thereby permitting the front of the seat part to be adjusted either upwardly or downwardly and rearwardly. To facilitate guiding of the pins into the cut-out portions the opposite side of the track may be provided with projections, not shown, oppposite the cut-outs. The upwardly and rearwardly extending links 19 at the rear of the seat part 15a cause a corresponding raising and forward or lowering and rearward movement. If desired more than two links 19 may be provided or a single wider link.

The back and seat parts 15 and 15a are provided with interior springing and upholstery in conventional manner.

Within the pack part 15 is provided a lumber support portion in the form of a wooden pad 24 of generally rectangular configuration having spaced apart upper and lower edges 25 and 26 in the present example approximately 5" apart although it should be appreciated that the spacing of the upper and lower edges may be greater or less and may for example be 7" apart. The forwardly facing surface 27 of the pad is of generally curved configuration in a plane normal to the upper and lower edges 25 and 26. At a position approximately mid-way between its upper and lower edges 25, 26 the lumber support portion is provided with a bearing sleeve 29 which is received in elongate slots 30 formed in side members 31 of the back part 15. A set screw 32 is threadedly received in each part 31, and rotation of the screw permits adjustment of the pins 28 forwardly and rearwardly relative to the parts 31. The inner end of each pin 28 is connected to the pad 24 by brackets 33 screwed to the pad.

At its outer end one pin has a radial link 34 fixed thereto and the free end of the link 34 is pivotally connected at 35 to a vertically extending arm 36 of a generally L- shaped lever 37. The horizontal part 38 of the lever 37 extends between the seat board 17 and one of the arm portions 12 in guides 39 and is provided with a manually engageable handle 40 and a plurality of cut-outs 41 in its lower surface, any desired one of which can be engaged with a tooth element 42 mounted on one of the guides 39.

It is preferred, and as shown, that the cut-outs 41 extend in opposite directions on either side of a central cut-out which extends generally normal to the longitudinal axis of the horizontal part 38 whilst those cut-outs which are forward of the central part extend rearwardly and upwardly whilst those which are rearward extend forwardly and upwardly.

Alternatively, any other desired linkage arrangement may be provided to adjust the position of the pad 24 and the manually engageable handle may be provided at the front of the chair beneath the seat board 17.

Because the angle between the seat part 15a and the back part 15 is adjustable automatically when the seat part 15a is raised or lowered, a user of this seat need not adjust his position frequently, as is necessary with known seats, to relieve the tension in the back muscles, but the seat may be adjusted instead. This will result in a change of position for the user of the seat.

This seat adjustment may result in discomfort for the user due to the lumbar support 24, then being in the wrong position relative to the user's back, or it may give the incorrect degree of support for the user in his new position. To compensate for the new position of the user, the position of the support 24 may then be adjusted for maximum comfort, and the height of the support for correct lumbar support.

Figure 3:
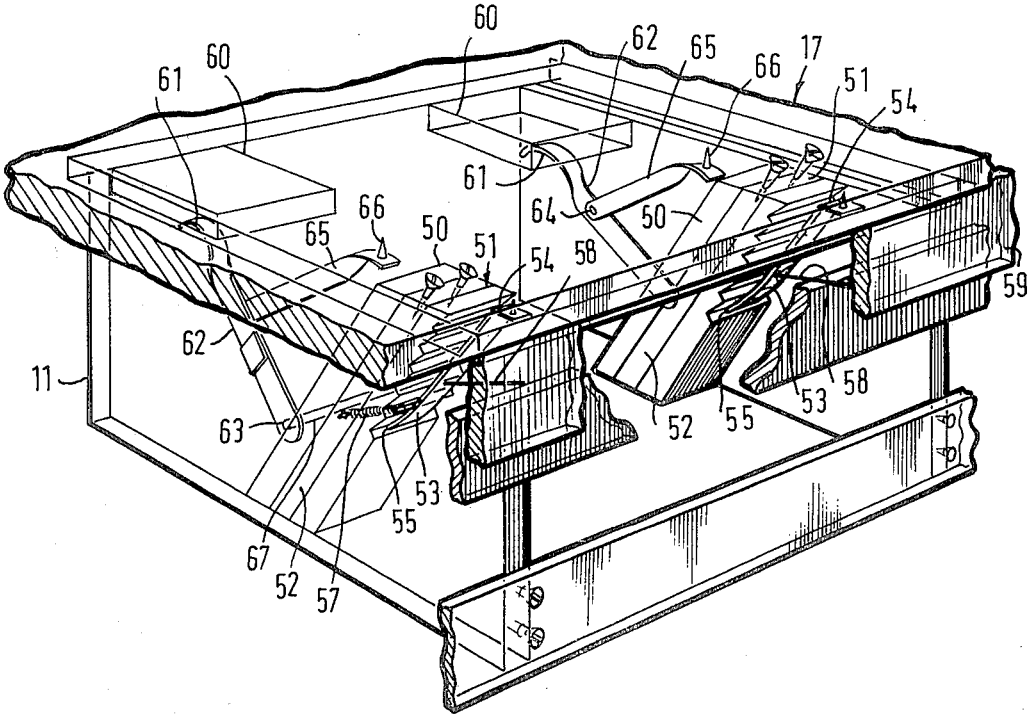
FIG. 3 is a perspective view of part of an alternative embodiment of the invention.

In a modified embodiment of the invention, referring to FIG. 3 the means for adjusting the position of the seat part 15a is different to that in the embodiment previously described. In all other respects the chairs are the same.

The frame 10 of the chair is provided, at each side, with guides 50 which each define a track 51 for a slide member 52 fixed to the underside of the seat board 17. A steel pawl member 53 is pivotally connected, as shown at 54 to the underside of the seat board and its free end 55 is adapted to engage with any desired of a plurality of ratchet teeth formed on the guide 50. A coil tension spring 57 is provided between each pawl 53 and the slide member 52. A cord 58 is connected to each pawl 53 at one end and to a pivoted apron rail 59 at its other end so that pivotal movement of the rail 59 will cause disengagement of the pawl member from the ratchet teeth.

A pad 60 is provided on the undersurface of the seat board 17 and is engaged by a curved part 61 of a line pivoted to the frame 10 as shown at 63. The link which is 62 is pivotally connected to a further link 65 which is fixed as shown at 66 to the underside of the seat board 17. An exactly similar link arrangement is provided at each side of the chair and the assemblies are connected together by a bar 67.

In both of the above described embodiments, a user of the chair may, by moving the handle 40 forwardly or rearwardly, cause tilting of the pad 24 which will thus adjust the effective height of the support afforded by the lumbar support portion. If the pad 24 is tilted to move the upper edge 25 forward the effective height of the support will be increased and vice versa.

A user of the chair may also adjust the height of the seat part 15a for his convenience by moving the pins 21 or pawls 53 at the forward end of the seat portion into a desired one of the cut outs 22 or ratchet teeth 56.

Figure 4:
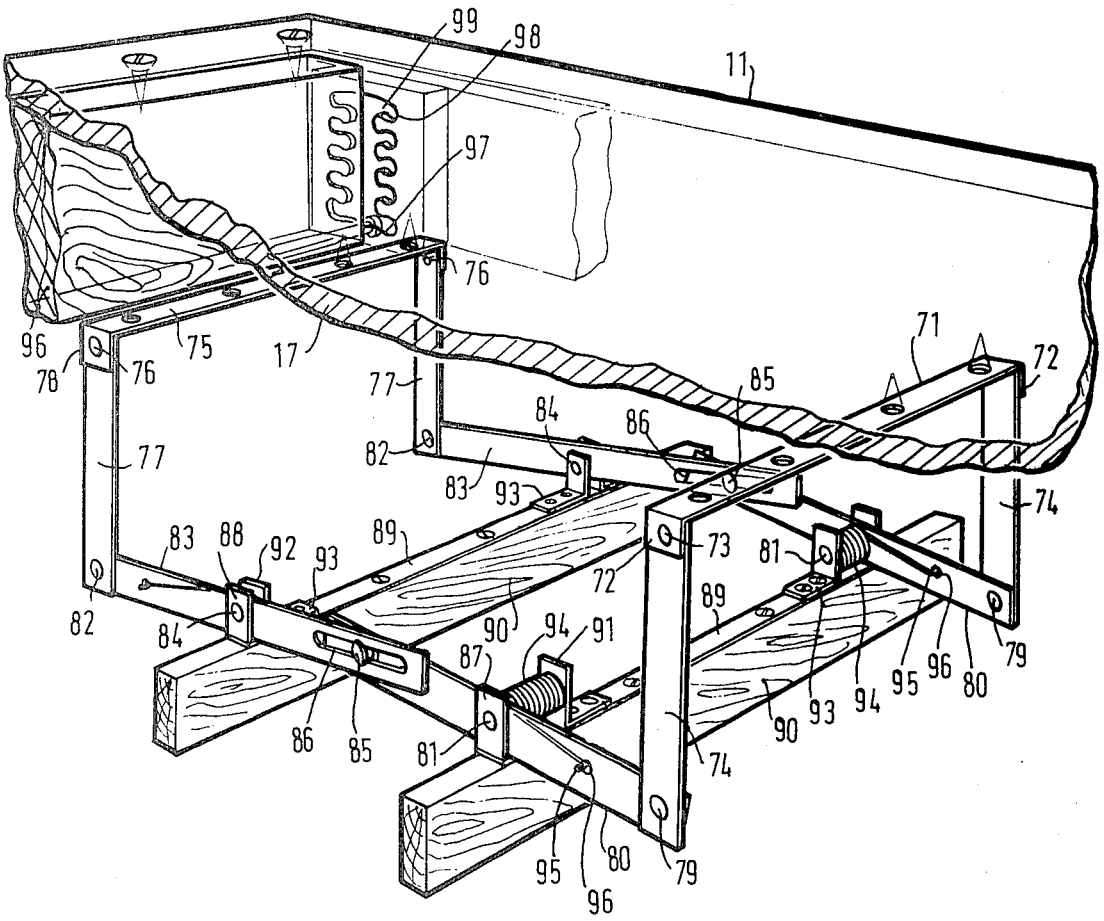
FIG. 4 is a perspective view of part of a further alternative embodiment of the invention.

Referring now to FIG. 4 the means for adjusting the position of the seat part 15a is different to that in the embodiments previously described. In all other respects the chairs are the same.

The seat part 15a has a seat board 17 which has fixed thereto, adjacent its rear edge, a strip 71 having downwardly depending end portions 72 which are pivotally connected at 73 to links 74. Adjacent the front edge of the seat board 17, but spaced inwardly thereof, in a second strip 75 having downwardly depending end portions 76 which are connected to strips 77 as shown at 78. The rearmost strips 74 are pivotally connected as shown at 79 to the ends of a pair of levers 80 which are pivotally mounted about an axle 81.

Likewise the front strips 77 are pivotally connected, as shown at 82 to further levers 83 which are pivotally mounted intermediate their ends on axles 84.

At their other ends the levers 80 are provided with stub axles 85 which are received in slots 86 formed in the other ends of the levers 83 so as to afford a pivotal and sliding connection between the levers 80 and 83.

The axles 81 and 84 are mounted in brackets afforded by upstanding portions 87 and 88 of strips 89 fixed to cross members 90 and upturned portions 91 and 92 of strips 93 also fixed to the members 90.

A coil tension spring 94 is mounted around each of the axles 81 and has end portions 95 received in apertures 96 of the links 80 and serving normally to bias the end of the levers 80 which carry the links 74 in an upwards direction.

Closely adjacent to the front of the seat board 17 a rail 96[1] is attached to the seat board and carries at each side a keeper bolt 97 each of which is received in any desired one of slots 98 provided in a track 99 fixed to the frame 11 of the chair.

In use, when the front edge of the seat board 17 is grasped and moved to engage the bolt 97 in a desired one of the slots 99 the strips 77 will likewise be moved upwardly or downwardly and thus cause pivotal movement of the levers 83 which will cause a corresponding movement of the levers 80 and hence a corresponding upward or downward movement of the strips 74 attached to the rear of the seat board 17.

The lumbar support may be adjusted as described in connection with the preceding embodiments.

The adjustments that can be made to this seat will also result in the same advantages to the user of the seat as described above with reference to the first and second embodiment.

Figure 5:
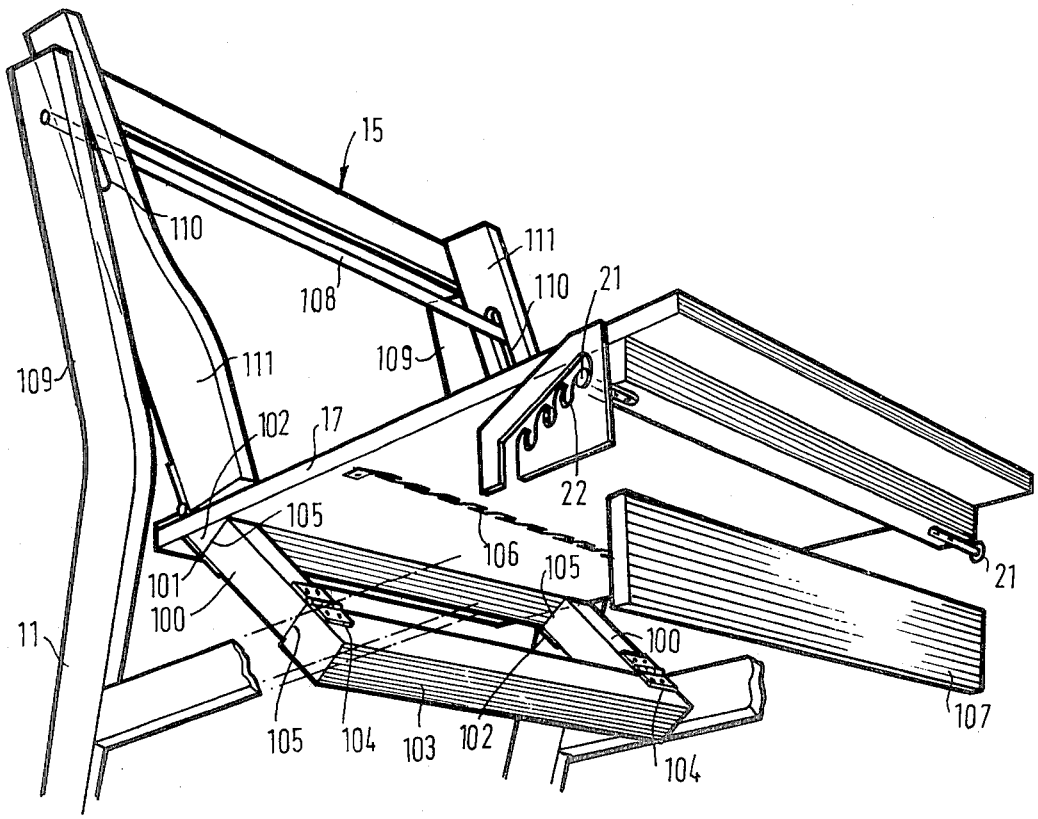
FIG. 5 is a perspective view of a still further alternative embodiment of the invention.

Referring now to FIG. 5 there is illustrated a seating which is basically similar to that described with reference to FIGS. 1 and 2 hereof except that the seat board 17 is supported at its rear end by a pair of links 100 which extend, in the lowermost location of the seat board illustrated in FIG. 5, in a rearwardly and upwardly direction. At its upper end each link 100 is connected by a hinge 101 to a block 102 fixed to the underside of the seat board 17 whilst at its lower end the link 100 is connected to a rail 103 fixed to the ground engaging frame 10 of the seating by means of hinges 104.

Because of abutment between the end surfaces of the links 100 and the adjacent surfaces of the block 102 as indicated by the lines 105, pivotal movement of the links 100 in a rearwardly and downwardly direction is prevented and thus the rear of the seat board is positively held in its lowermost position as well as being restrained therein by virtue of engagement of pins 21 in a desired one of cut-outs 22 which are provided at the front of the seat board 17 as described in more detail with reference to FIGS. 1 and 2 hereof.

When it is desired to raise the seat part **15*a* the front of the seat part 15*a* is grasped and the pin 21 engaged in the desired, higher, one of the cut-outs 22 and this causes upward and forward pivotal movement of the links 100 which is permitted by the hinges 101 and 104**.

This upward forward movement of the seat part is facilitated by providing a tension spring 106, for example, of the "NO-SAG" type, between the seat board 17 and a fixed part 107 of the frame 10.

The upper end of the back part 15 is connected to the frame 10 by means of a steel rod 108 which is fixed to leg members 109 which comprise a part of the ground engaging frame 10 of the seating and the rod 108 passes through an elongated slot 110 formed in the side members 111 of the back part 15 so that the back part is mounted for up and down movement together with the seat. It will be noted that the slots 110 are inclined downwardly and forwardly so that the upper end of the seat part moves upwardly and rearwardly and downwardly and forwardly when the seat part is so raised and lowered.

The adjustments described with reference to this embodiment, will also result in the advantages described above with reference to the first embodiment, to the user of the seat.

A similar connection between the back part 15 and the frame 10 may be used in all embodiments of the invention. A lumbar support panel as described in connection with FIGS. 1 and 2 may be provided in this embodiment.

If desired the height of the front of the chair may be adjusted by means other than those described hereinbefore, for example, by means of a screw jack arrangement. Also if desired the position of the lumbar support portion may be adjusted by means other than that described hereinbefore, for example, by moving the support portion bodily upwardly and downwardly relative to the remainder of the back portion.

If desired, and as shown in FIG. 1, the back part 15 may be provided, at its upper end, with a neck roll 120 in the form of an upholstered support portion 121 and an attachment part 122. The support portion 121 has a profile which corresponds to the configuration of of the nape of the neck and rear of the head of the user and thus comprises an upper support part 123, adapted to engage the rear of the head and lower forwardly projecting part 124 adapted to engage and support the nape of the neck. The attachment part 122 extends over the top of the back part 15 and the wings 13 of the chair and is provided with press-studs or VELCRO (Registered Trade Mark) type fastening to secure the attachment part in position.

Preferably a sheet of covering material such as a woven fabric is provided over the rear side of each wing 13 to cover the mechanism therewithin and preferably a zip or other fastener is provided in the sheet to provide a fold-down panel to permit access to be gained to the mechanism for example for the purpose of adjusting the position of the set screws 32.

In order that the seat is comfortable for a user the seat is dimensioned and provided with a range of adjustments as set out in the table below:

| | | | | | |
|---|---|---|---|---|---|
| Height of seat | 17" | 18" | 18¾" | 19½" | 21" |
| Height of seat at back. | 17" | 17¾" | 18¼" | 18⅝" | 19" |
| Pitch of seat | 0° | 3° | 2° | 3° | 7° |
| Angle of seat and back (approx figures) | 112° | 110° | 110° | 110° | 112° |

In the above table the term "pitch" is intended to refer to the angle at which the seat part **15*a*** extends in an upwardly and forward direction relative to the horizontal.

Preferably the seat part **15*a* is provided with a relatively raised or roll front portion to support a user of the chair with his knees raised and hence tend to ensure that the back of the user is maintained closely adjacent the back part 15**.

What we claim is:

1. An adjustable seating comprising a ground engaging frame portion, a seat part and a back part, means for mounting said seat and back parts on the frame portion, an adjustable lumbar support portion, mounting means for mounting said support portion for movement relative to the back part and means to permit raising and lowering movement of both the front and the rear of the seat part and variation of the angle between the seat part and the back part, wherein said means for mounting said seat and back parts on the frame portion comprises a pivoted link by which the seat part is connected adjacent its rear end to the frame portion and means whereby the forward end is locatable in any desired one of a plurality of locations which lie on a line which extends upwardly and forwardly, the link being inclined upwardly and rearwardly from the frame part to the seat part whereby raising and corresponding forward movement of the front of the seat part causes raising and forward movement of the rear end of the seat part.

2. An adjustable seating comprising a ground engaging frame portion, a seat part and a back part, means for mounting said seat and back parts on the frame portion, an adjustable lumbar support portion, mounting means for mounting said support portion for movement relative to the back part and means to permit raising and lowering movement of both the front and the rear of the seat part and variation of the angle between the seat part and the back part, wherein said means for mounting said seat and back parts on the frame portion comprises a first lever and second lever, the first lever being pivoted intermediate its ends and connected at one end to the front of the seat part and connected at its other end to the second lever which is pivoted intermediate its ends and the other end of which is connected to the rear of the seat part the connection between levers permitting pivotal and sliding movement therebetween.

3. A seating according to claim 2 wherein biasing means are provided to bias at least one of the levers in a direction to cause upward movement of its associated end of the seat part.

4. A seating comprising a ground engaging frame portion, upholstered arms, wings and back part, the arms extending within the wings towards the back part, and the seat part substantially contained by and in close relationship with the arms and the back part, the seat part having a rear end adjacent the back part and a front, means mounting said seat part and back parts on the ground engaging frame portion, said means comprising adjustment means including interengageable abutment means at the front of the seat part to permit of raising and lowering of the front of the seat part relative to the ground engaging frame portion into any one of a number of predetermined positions, and links between said seat part and the frame portion arranged so that the raising or lowering movement of the front of the seat part causes a corresponding movement of the rear of the seat part, said adjustment means also comprising pivot means between said seat and back parts permitting variation of the angle between the seat and back parts.

5. A seating according to claim 4 wherein manually engageable means are provided adjacent its front part to enable a user of the seating to adjust the height of both the front and rear of the seat part and the angle between the seat part and the back part.

6. A seating according to any one of the preceding claims wherein there is provided in the back part an adjustable lumbar support portion which may be moved upwards and downwards relative to the remainder of the back part.

7. A seating according to claim 6 wherein the lumbar support portion comprises a pad having spaced apart upper and lower edges said mounting means supporting said pad so that said pad can be pivoted about a horizontal axis intermediate said edges and retained in position.

8. A seating according to claim 7 having a manually engageable part and means connecting said manually engageable part to the lumbar support portion whereby the position of the lumbar support portion may be adjusted by a person sitting in the seating.

9. A seating according to claim 8 having means connecting the back part to the seat part whereby said parts may move upwardly and downwardly together.

10. A seating according to claim 6 wherein as the seat height is adjusted the angle between the seat part and the back part is advantageously varied.

* * * * *

UNITED STATES PATENT AND TRADEMARK OFFICE

CERTIFICATE OF CORRECTION

PATENT NO. : 4,222,607

DATED : September 16, 1980

INVENTOR(S) : JAMES DIMMOCK

It is certified that error appears in the above-identified patent and that said Letters Patent are hereby corrected as shown below:

On the Title Sheet under item [30], the priority date has been transposed. "April 10, 1977" should be --October 4, 1977--.

Col. 2, line 12, "thereby" should be --whereby--.

Col. 3, line 8, "pack" should be --part--.

Col. 4, line 15, "line" should be --link--.

Col. 4, line 42, "in" should be --is--.

Signed and Sealed this

Thirtieth Day of June 1981

[SEAL]

Attest:

RENE D. TEGTMEYER

Attesting Officer

Acting Commissioner of Patents and Trademarks